US006058813A

United States Patent [19]

Bryant et al.

[11] Patent Number: 6,058,813

[45] Date of Patent: May 9, 2000

[54] LOCKNUT WRENCH

[76] Inventors: Paul Bryant, 7768 Lester Dr., Painesville, Ohio 44077; Barry Douglas Luthanen, 417 Seventh St., Fairport Harbor, Ohio 44077

[21] Appl. No.: 09/218,292

[22] Filed: Dec. 22, 1998

[51] Int. Cl.[7] ..... B25B 13/06; B25B 13/56

[52] U.S. Cl. ..... 81/176.15; 81/177.7; 81/124.2

[58] Field of Search ..... 81/124.2, 176.1, 81/176.15, 176.2, 121.1, 124.7, 177.8, 177.7

[56] References Cited

U.S. PATENT DOCUMENTS

| | | | |
|---|---|---|---|
| 2,182,673 | 12/1939 | Magnano | 81/177.7 X |
| 3,340,914 | 9/1967 | Ricks | 81/177.1 |
| 3,768,345 | 10/1973 | Barnes | 81/176.15 |
| 4,227,429 | 10/1980 | Bowers, Jr, et al. . | |
| 5,524,511 | 6/1996 | Taka's | 81/176.15 |

*Primary Examiner*—D. S. Meislin

[57] ABSTRACT

A locknut wrench is disclosed. The locknut wrench has a handle having a gripping end with a cylindrical gripping area there adjacent. The handle also has a coupling end formed of spaced parallel arms with a slot therebetween with aligned apertures through the arms. An intermediate portion is formed between the gripping end and coupling end. The wrench has a head in a generally cylindrical configuration having a lower end formed of a cylindrical wall with an upstanding recess for the receipt of a locknut, with a plurality of downwardly extending legs for removable coupling with respect to a locknut to be turned. The wall of the head is formed with an upwardly extending wire port in a generally rectangular configuration for the passage of wires therethrough. The upper extent of the head has an aperture of an enlarged diameter therethrough in axial alignment with the apertures of the handle. A cylindrical pivot pin extends through the apertures of the handle and is coupled with respect thereto as well as the aperture of the head with the aperture of the head being of a slightly enlarged diameter to allow the pivoting of the head with respect to the pin and the handle.

2 Claims, 2 Drawing Sheets

LOCKNUT WRENCH

BACKGROUND OF THE INVENTION

1. Field of the Invention

The present invention relates to a locknut wrench and more particularly pertains to applying a proper rotational torque to a locknut during tightening and removal with the ability to fit around wires adjacent to the locknut and wherein the coupled locknut may be in a difficult-to-reach area.

2. Description of the Prior Art

The use of wrenches of known designs and configurations is known in the prior art. More specifically, wrenches of known designs and configurations heretofore devised and utilized for the purpose of applying rotational torque to rotatable fasteners through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,524,511 to Taka's, issued Jun. 11, 1996 discloses a locknut tool. U.S. Pat. No. Des. 274,881 to Wilsey, issued Jul. 31, 1984 discloses an ornamental rendering of a socket. U.S. Pat. No. 3,768,345 to Barnes, issued Oct. 30, 1973 discloses a lock nut drive head. U.S. Pat. No. 3,383,962 to Harris, issued May 21, 1968 discloses a ratchet-wrench construction. U.S. Pat. No. 2,270,092 to Thompson, issued Jan. 13, 1942 discloses a wrench for lock nuts. Lastly, international application published under the Patent Cooperation Treaty, WO 96/11774 to Hillinger, publication date Apr. 25, 1996, discloses a ratcheting socket wrench with intermeshing gears.

While these devices fulfill their respective, particular objectives and requirements, the aforementioned patents do not describe a locknut wrench that allows applying a proper rotational torque to a locknut during tightening and removal with the ability to fit around wires adjacent to the locknut and wherein the coupled locknut may be in a difficult-to-reach area.

In this respect, the locknut wrench according to the present invention substantially departs from the conventional concepts and designs of the prior art, and in doing so provides an apparatus primarily developed for the purpose of applying a proper rotational torque to a locknut during tightening and removal with the ability to fit around wires adjacent to the locknut and wherein the coupled locknut may be in a difficult-to-reach area.

Therefore, it can be appreciated that there exists a continuing need for a new and improved locknut wrench which can be used for applying a proper rotational torque to a locknut during tightening and removal with the ability to fit around wires adjacent to the locknut and wherein the coupled locknut may be in a difficult-to-reach area. In this regard, the present invention substantially fulfills this need.

SUMMARY OF THE INVENTION

In view of the foregoing disadvantages inherent in the known types of wrenches of known designs and configurations now present in the prior art, the present invention provides an improved locknut wrench. As such, the general purpose of the present invention, which will be described subsequently in greater detail, is to provide a new and improved locknut wrench and method which has all the advantages of the prior art and none of the disadvantages.

To attain this, the present invention essentially comprises a new and improved locknut wrench system for applying a proper rotational torque to a locknut during tightening and removal with the ability to fit around wires adjacent to the locknut and wherein the coupled locknut may be in a difficult-to-reach area comprising, in combination, a handle having a gripping end with a cylindrical gripping area thereadjacent with a first enlarged diameter, the handle also having a coupling end formed of spaced parallel arms with a slot therebetween with aligned apertures of a reduced diameter extending through the arms, the handle also having an intermediate portion between the gripping end and coupling end, the intermediate portion having a circular cross-sectional configuration of a second reduced diameter; a head in a generally cylindrical configuration having a lower end formed of a cylindrical wall with an upstanding recess for the receipt of a locknut, the recess having a lower cylindrical zone and an upper cone-shaped zone with a plurality, preferably two diametrically opposed pair, of downwardly extending legs each in a generally rectangular configuration for removable coupling with respect to a locknut to be turned, the wall of the head being formed with an upwardly extending wire port in a generally rectangular configuration for the passage of wires therethrough, the upper extent of the head having a frusto-conical configuration region with an upstanding projection adapted to fit within the recess of the handle and with an aperture of an enlarged diameter therethrough in axial alignment with the apertures of the handle; a cylindrical pivot pin extending through the apertures of the handle and coupled with respect thereto as well as the aperture of the head with the aperture of the head being of a slightly enlarged diameter to allow the pivoting of the head with respect to the pin and the handle; and a cover of an elastomeric material in a generally cylindrical configuration with an interior surface adapted to be friction fit over the gripping area and with an exterior surface adapted to be grasped by the user during operation and use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved locknut wrench which has all of the advantages of the prior art wrenches of known designs and configurations and none of the disadvantages.

It is another object of the present invention to provide a new and improved locknut wrench which may be easily and efficiently manufactured and marketed.

It is further object of the present invention to provide a new and improved locknut wrench which is of durable and reliable constructions.

An even further object of the present invention is to provide a new and improved locknut wrench which is susceptible of a low cost of manufacture with regard to both materials and labor, and which accordingly is then susceptible of low prices of sale to the consuming public, thereby making such locknut wrench economically available to the buying public.

Even still another object of the present invention is to provide a locknut wrench for applying a proper rotational torque to a locknut during tightening and removal with the ability to fit around wires adjacent to the locknut and wherein the coupled locknut may be in a difficult-to-reach area.

Lastly, it is an object of the present invention to provide a new and improved locknut wrench. The locknut wrench has a handle having a gripping end with a cylindrical gripping area thereadjacent. The handle also has a coupling end formed of spaced parallel arms with a slot therebetween with aligned apertures through the arms. An intermediate portion is formed between the gripping end and coupling end. The wrench has a head in a generally cylindrical configuration having a lower end formed of a cylindrical wall with an upstanding recess for the receipt of a locknut, with a plurality of downwardly extending legs for removable coupling with respect to a locknut to be turned. The wall of the head is formed with an upwardly extending wire port in a generally rectangular configuration for the passage of wires therethrough. The upper extent of the head has an aperture of an enlarged diameter therethrough in axial alignment with the apertures of the handle. A cylindrical pivot pin extends through the apertures of the handle and is coupled with respect thereto as well as the aperture of the head with the aperture of the head being of a slightly enlarged diameter to allow the pivoting of the head with respect to the pin and the handle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
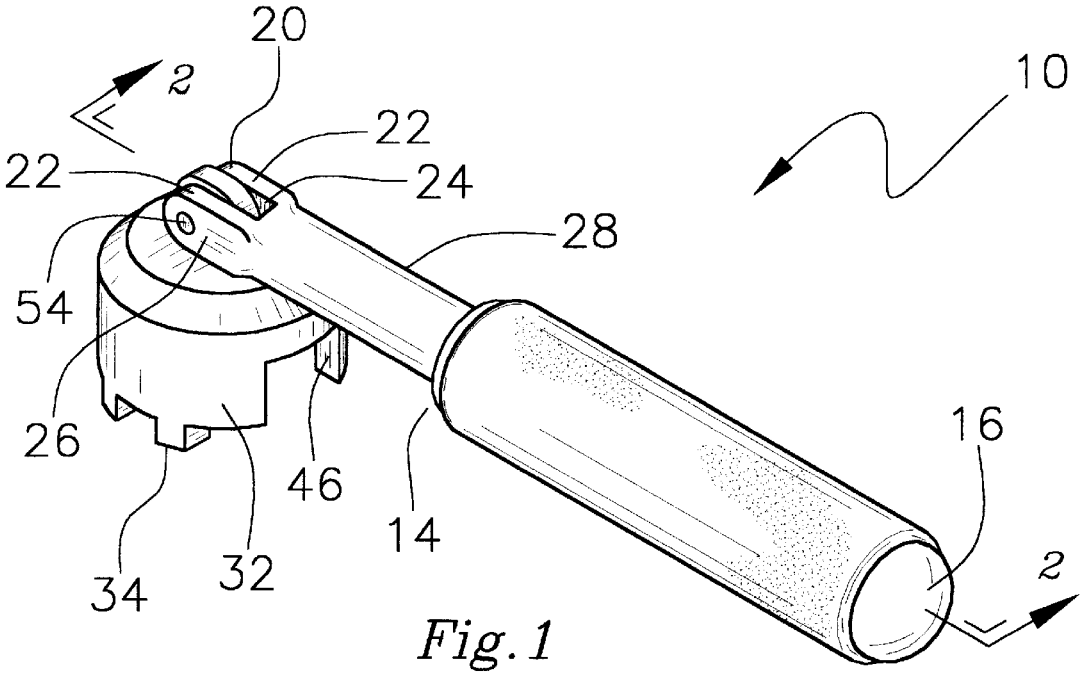
FIG. 1 is a perspective illustration of the new and improved locknut wrench constructed in accordance with the principles of the present invention.

With reference now to the drawings, and in particular to FIG. 1 thereof, the preferred embodiment of the new and improved locknut wrench embodying the principles and concepts of the present invention and generally designated by the reference numeral 10 will be described.

The present invention, the locknut wrench 10, is comprised of a plurality of components. Such components in their broadest context include a handle, a head, a pivot pin and a cover. Such components are individually configured and correlated with respect to each other so as to attain the desired objective.

The first component of the new and improved locknut wrench system 10 for applying a proper rotational torque to a locknut during tightening and removal with the ability to fit around wires adjacent to the locknut and wherein the coupled locknut may be in a difficult-to-reach area is a handle 14. The handle has a gripping end 16 with a cylindrical gripping area 18 thereadjacent with a first enlarged diameter. The handle also has a coupling end 20. The coupling end is formed of spaced parallel arms 22 with a slot 24 therebetween with aligned apertures 26 of a reduced diameter extending through the arms. The handle further has an intermediate portion 28 between the gripping end and coupling end. The intermediate portion has a circular cross-sectional configuration of a second reduced diameter.

The second major component of the system 10 is a head 32. The head is formed in a generally cylindrical configuration. The head comprises a lower end 34 formed of a cylindrical wall 36 with an upstanding recess 38 for the receipt of a locknut. The recess has a lower cylindrical zone 40 and an upper cone-shaped zone 42. The recess further has a plurality, preferably two diametrically opposed pair, of downwardly extending legs 44 each in a generally rectangular configuration for removable coupling with respect to a locknut to be turned. The wall of the head is formed with an upwardly extending wire port 46, in a generally rectangular configuration for the passage of wires therethrough. The upper extent of the head has a frusto-conical configuration region 48 with an upstanding projection 50 adapted to fit within the recess of the handle. The upper extent of the head further has an aperture of an enlarged diameter therethrough in axial alignment with the apertures of the handle.

The third major component of the system 10 is a cylindrical pivot pin 54. The pivot pin extends through the apertures of the handle and is coupled with respect thereto as well as the aperture of the head. The aperture of the head is formed of a slightly enlarged diameter to allow the pivoting of the head with respect to the pin and the handle.

The last major component of the system is a cover 58. The cover is formed of an elastomeric material in a generally cylindrical configuration. The cover has an interior surface 60 adapted to be friction fit over the gripping area and an exterior surface 62 adapted to be grasped by the user during operation and use.

Figure 2:
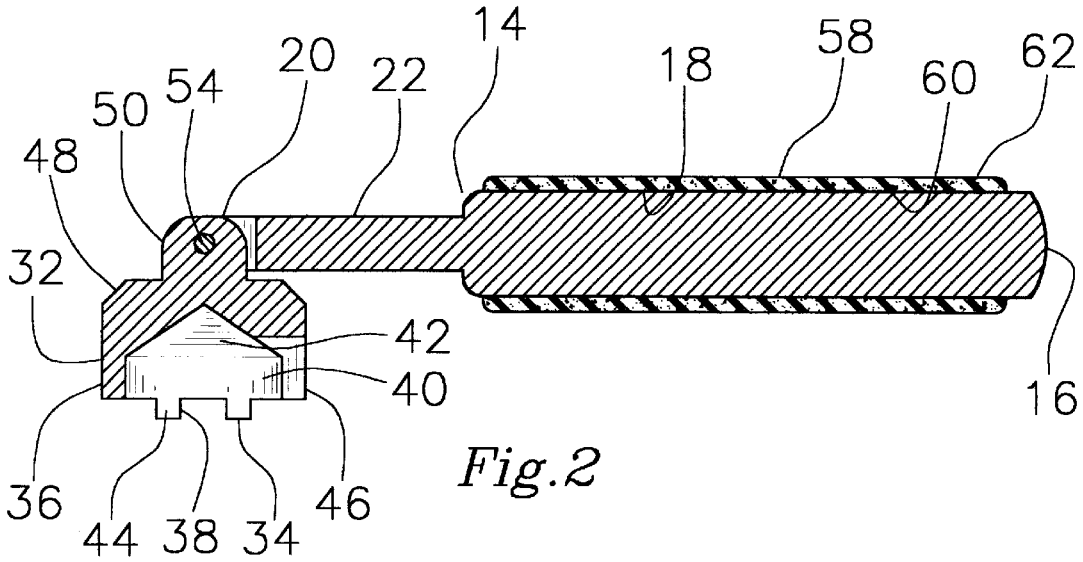
FIG. 2 is a cross-sectional view taken along line 2—2 of FIG. 1.
Figure 3:
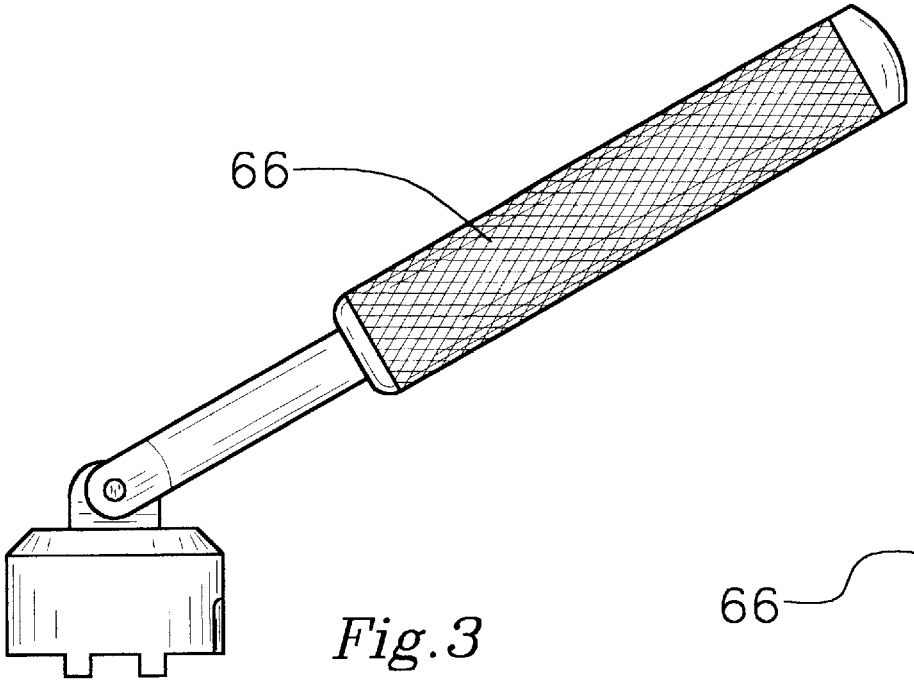
FIG. 3 is a side elevational view of the device shown in FIG. 1 but constructed in accordance with an alternate embodiment of the invention and featuring a knurled handle rather than an elastomeric cover.
Figure 4:
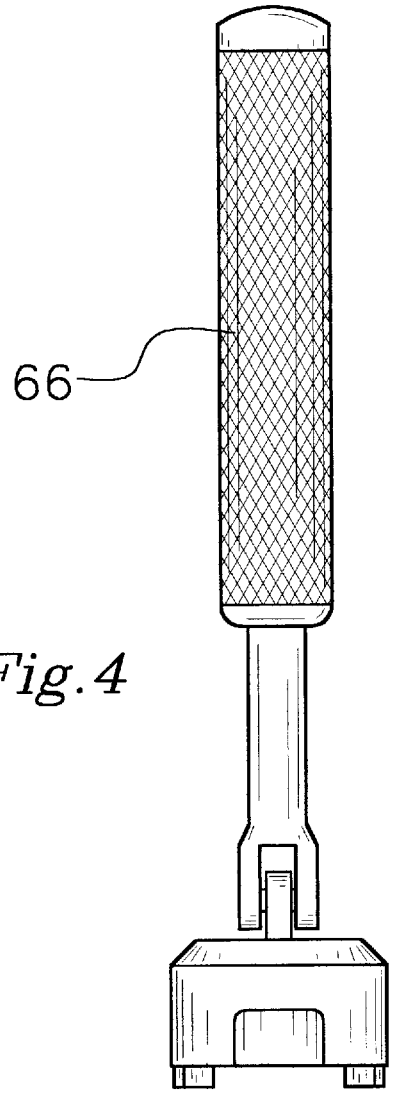
FIG. 4 is a front elevational view of the device shown in FIG. 3.
Figure 5:
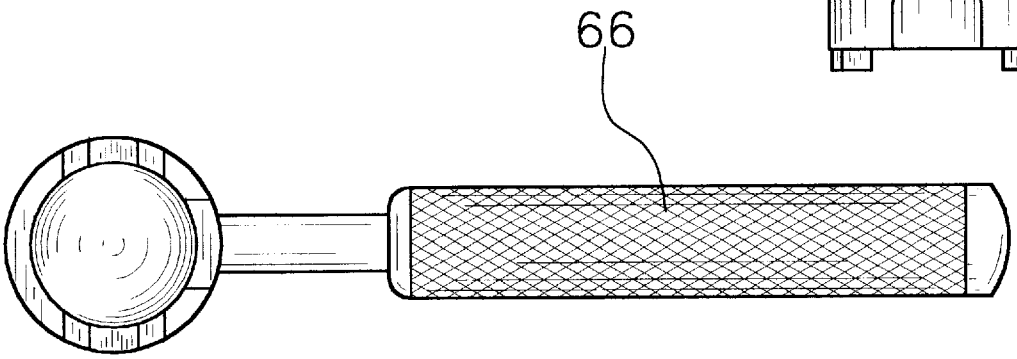
FIG. 5 is a bottom elevational view of the device shown in FIGS. 3 and 4.

An alternate embodiment of the invention is shown in FIGS. 3, 4 and 5. In such alternate embodiment, the locknut wrench is essentially identical to the embodiment shown in FIGS. 1 and 2. The only difference is that the cover 58 formed of an elastomeric material is removed. In its place, the exterior surface of the gripping end of the handle is formed as a knurled surface 66 to further allow for the comfortable and efficient grasping of the handle during operation and use.

The present invention is a wrench especially designed for application with certain types of locknuts used in many electrical components, such as light fixtures, and virtually all conduit systems. This wrench fits on the locknut with ease in the difficult-to-reach areas where the locknuts are commonly used. The present invention makes it easy to apply the proper torque to the nut for tightening or removal.

Examples of different types of conduit or materials that are installed with locknuts, and therefore provide use for the present invention, include the following: thinwall EMT, rigid/intermediate conduit, flex cord and power cable, liquid tight flex, or nonmetallic, armored cable or metal flex, rigid/nonmetallic, rigid aluminum threaded conduit and conduit bodies.

The present invention may be machined, forged, or casted from tool steel. The handle features a textured grip and is insulated to prevent electrical shock. The present invention includes 11 different size configurations to correspond to the 11 different sizes of locknuts presently in use.

The head of the present invention features a wire port, a slot to fit around wires that are leading to or through the locknut. The heads' socket-attachment to the wrench allows the head to be swiveled a full 180 degrees in relation to the handle, allowing easy application to a locknut in any location. In hard-to-reach places such as the end of a fluorescent light fixture or the back side of a work box, the present invention still fits and works with ease.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A locknut wrench system for applying a proper rotational torque to a locknut during tightening and removal with the ability to fit around wires adjacent to the locknut and wherein the coupled locknut may be in a difficult-to-reach area comprising, in combination:

a handle having a gripping end with a cylindrical gripping area, the gripping area having a first enlarged diameter, the handle also having a coupling end formed of spaced parallel arms with a slot therebetween with aligned apertures of a reduced diameter extending through the arms, the handle also having an intermediate portion between the gripping end and coupling end, the intermediate portion having a circular cross-sectional configuration of a second reduced diameter;

a head in a generally cylindrical configuration having a lower end formed of a cylindrical wall, the lower end being formed with an upstanding recess for the receipt of a locknut, the recess having a lower cylindrical zone and an upper cone-shaped zone with two diametrically opposed pairs of downwardly extending legs each in a generally rectangular configuration extending downwardly from the cylindrical wall for removable coupling with respect to a locknut to be turned, the wall of the head being formed with an upwardly extending wire port in a generally rectangular configuration for the passage of wires therethrough, the head having an upper extent with a frusto-conical configuration region and with an upstanding projection adapted to fit within the slot of the handle and with an aperture of an enlarged diameter therethrough in axial alignment with the apertures of the handle;

a cylindrical pivot pin extending through the apertures of the handle and coupled with respect thereto as well as extending through the aperture of the heads with the aperture of the head being of a slightly enlarged diameter to allow the pivoting of the head with respect to the pin and the handle; and a cover of an elastomeric material in a generally cylindrical configuration with an interior surface friction fit over the gripping area and with an exterior surface adapted to be grasped by the user during operation and use.

2. A locknut wrench system for applying a proper rotational torque to a locknut during tightening and removal with the ability to fit around wires adjacent to the locknut and wherein the coupled locknut may be in a difficult-to-reach area comprising, in combination:

a handle having a gripping end with a cylindrical gripping area, the gripping area having a first enlarged diameter, the handle also having a coupling end formed of spaced parallel arms with a slot therebetween with aligned apertures of a reduced diameter extending through the arms, the handle also having an intermediate portion between the gripping end and coupling end, the intermediate portion having a circular cross-sectional configuration of a second reduced diameter;

a head in a generally cylindrical configuration having a lower end formed of a cylindrical wall, the lower end being formed with an upstanding recess for the receipt of a locknut, the recess having a lower cylindrical zone and an upper cone-shaped zone with two diametrically opposed pairs of downwardly extending legs each in a generally rectangular configuration extending downwardly from the cylindrical wall for removable coupling with respect to a locknut to be turned, the wall of the head being formed with an upwardly extending wire port in a generally rectangular configuration for the passage of wires therethrough, the head having an upper extent with a frusto-conical configuration region and with an upstanding projection adapted to fit within the slot of the handle and with an aperture of an enlarged diameter therethrough in axial alignment with the apertures of the handle;

a cylindrical pivot pin extending through the apertures of the handle and coupled with respect thereto as well as extending through the aperture of the head, with the aperture of the head being of a slightly enlarged diameter to allow the pivoting of the head with respect to the pin and the handle; and the exterior surface of the gripping area being a knurled surface.

* * * * *